US005443288A

United States Patent [19]

Miles

[11] Patent Number: 5,443,288

[45] Date of Patent: Aug. 22, 1995

[54] PREGNANCY ADVENT CALENDAR

[76] Inventor: Barbara L. Miles, 4720 Cheyenne Ct., Boulder, Colo. 80303

[21] Appl. No.: 280,000

[22] Filed: Jul. 25, 1994

[51] Int. Cl.[6] ..... B42D 5/04

[52] U.S. Cl. ..... 283/2

[58] Field of Search ..... 283/2, 3, 4; 40/335, 40/107

[56] References Cited

U.S. PATENT DOCUMENTS

| | | | |
|---|---|---|---|
| 2,582,355 | 1/1952 | Ratner | 283/2 X |
| 2,831,278 | 4/1958 | Myers | 283/2 X |
| 3,290,812 | 12/1966 | Hunkins | 283/2 X |
| 5,090,733 | 2/1992 | Bussiere | 283/2 |
| 5,135,260 | 8/1992 | Irlik et al. | 283/2 |
| 5,207,580 | 5/1993 | Strecher | 434/238 |

*Primary Examiner*—Willmon Fridie

*Attorney, Agent, or Firm*—Duft, Graziano & Forest

[57] ABSTRACT

An advent type calendar used to inform or educate the user as to milestones of the human fetal development process. Tabs are pre-formed in, and peel back from, a top surface of the calendar to reveal messages which inform the user as to the current development level of the human fetus. Each tab is labelled with the week corresponding to the message below relating to human fetal development. The calendar of the present invention may also be applied to educate the user as to developmental progress of other time constrained development processes.

5 Claims, 3 Drawing Sheets

PREGNANCY ADVENT CALENDAR

FIELD OF THE INVENTION

This invention relates in general to calendars and, more specifically, to an advent type calendar designed to inform pregnant mothers of the milestones of human fetal gestation.

PROBLEM

Calendars used simply for the marking of the passage of time have been known for millennia. Other calendar designs have incorporated figures or messages for aesthetic enhancement of the calendar. Many previous calendars have been designed which provide humorous, religious, or inspirational messages for a user associated with each day. For example, Christmas Advent calendars provide religious inspiration through messages and figures relating to the biblical teachings of the Christmas season.

In U.S. Pat. No. 2,831,278, issued Apr. 22, 1958, R. H. Myers discloses a calendar structure which permits a user to write personal reminder messages under a moveable tab covering each date on the monthly calendar.

In U.S. Pat. No. 5,207,580, issued May 4, 1993, Victor J. Strecher discloses a calendar manufactured with customized textual messages relating to a specific health or behavior modification goal for a particular individual. Motivational messages as well as reminder messages are displayed in appropriate days of each related month. The specific days, months, and messages unique to the particular individuals behavior modification or health related goal.

In U.S. Pat. No. 5,090,733, issued Feb. 25, 1992, R. Bussiere discloses a calendar with inspirational and motivational messages indicating thoughts or actions for each day, the goal of which is to inspire self-improvement. The messages are printed on moveable tabs and relate to sections of a picture so that as messages are added or revealed, a picture is being constructed to inspire the user to fulfill a personal objective.

These past designs are not associated with the timing of any specific event comprising part of a time interval but rather relate to abstractions such as personal reminders, inspiration, or motivation. The periods of time associated with these past designs are arbitrary in that they are not related to the timing of any particular event or interval. There is an apparent need for a calendar which is useful to inform a user as to the progress of timing and development of a specific time constrained event or interval. For example, to educate an expectant mother as to the fetal development process and the associated milestones of the human gestation period.

SOLUTION

The present invention comprises a calendar which serves to educate a user as to the fetal development process of the human gestation period. In addition, the calendar of the present invention serves to develop the interest of the user in the fetal development process. In an exemplary preferred embodiment, the calendar comprises an upper paper layer on which an image is printed. The upper paper layer is applied atop a lower substrate layer. Rectangular areas (also referred to as "flaps") of varying sizes within the image are cut into the upper paper layer. The rectangular areas are formed with tabs which a user may grip to lift the rectangular area up from the upper paper layer. Under each rectangular area, on the lower substrate layer, a message is printed. A user lifts the tab, raising a related rectangular area, to read the corresponding message under each rectangular area.

Each rectangular area is labelled with a number ranging from 3 through 40 corresponding to particular weeks in the interval comprising the normal human gestation period. The message under each labelled rectangular area tab informs the user of the progress of fetal development for the corresponding week of the human gestation period. Each week, the user lifts another tab to view the message corresponding to the labelled week of the gestation period. The effect of the collection of messages is to educate the user as to the milestones of progress in the fetal development process as well as to develop the users interest in the fetal development process.

More generally, the calendar of the present invention informs and educates the user with respect to milestones in the development of a time constrained development process. Child development is another example of such a timed development process spread through a number of years.

DETAILED DESCRIPTION OF THE INVENTION

Figure 1:
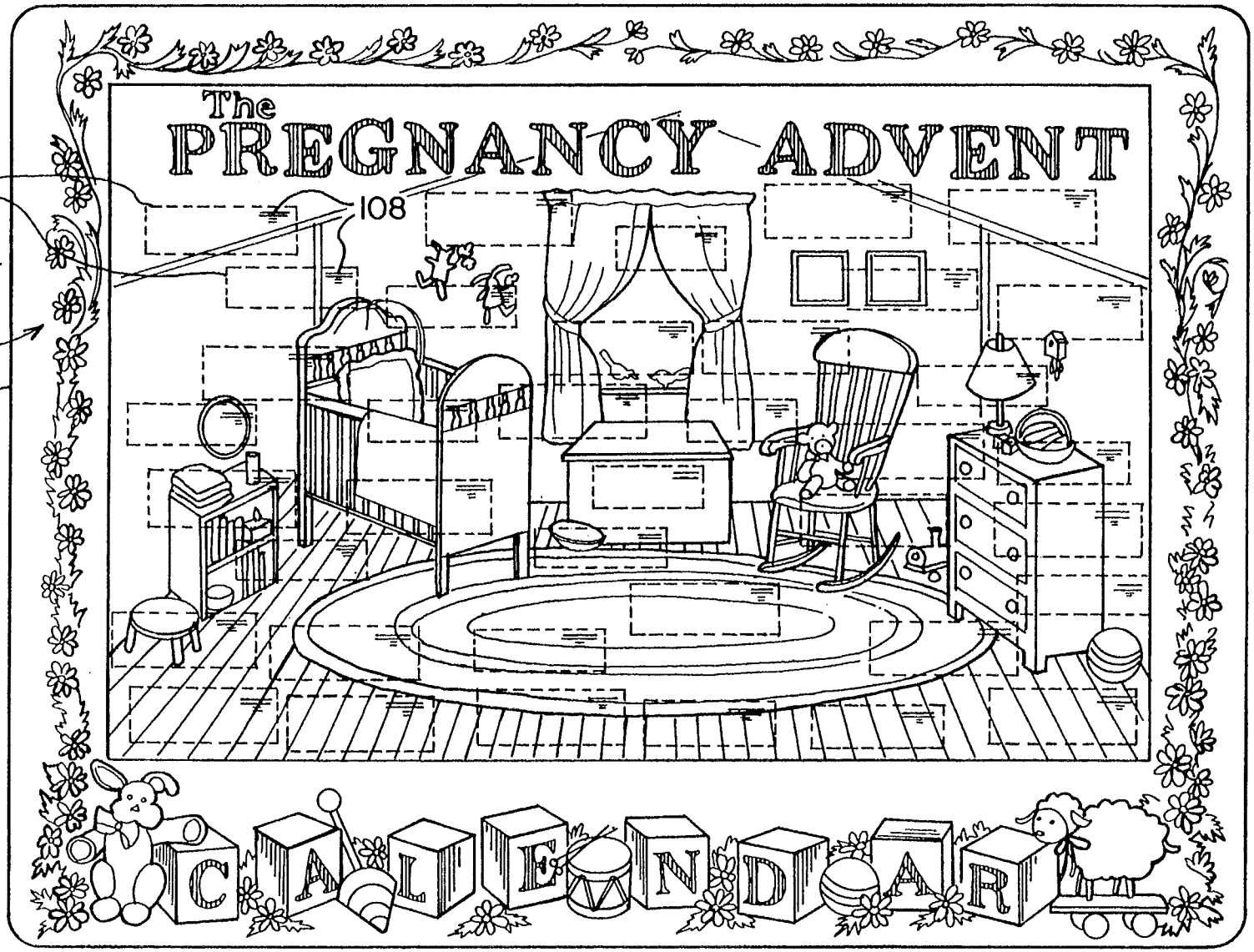
FIG. 1 shows the front of the one possible exemplary embodiment of a calendar of the present invention with the graphical image emphasized more than the tabbed rectangular areas.

FIG. 1 is a front view of calendar 100 of the present invention. Upper paper layer 102 has image 104 applied to its surface depicting a comforting, maternal scene. It will be recognized by those skilled in the art that image 104 applied to upper paper layer 102 may be of any desired scene. Upper paper layer 102 is affixed to a paper substrate paper layer (not shown in FIG. 1) which provides structural rigidity. Tabbed rectangular areas 106 (shown in dotted lines on FIG. 1) are preformed in upper paper layer 102. Three sides of each tabbed rectangular area 106 are pre-cut in upper paper layer 102 to weaken the edges of each tabbed rectangular area 106 so that it may be lifted up and folded back to hinge at the fourth edge of the tabbed rectangular area 106. Each tabbed rectangular area 106 is labelled to indicate a week number 108 of the human gestation period ("WEEK 3" through "WEEK 40"). Under each tabbed rectangular area 106, on the paper substrate paper layer (not shown in FIG. 1), is a printed message (not shown in FIG. 1). Each printed message informs the user as to the progress of human fetal development at the time period corresponding to the week number 108 label on the tabbed rectangular area 106. Each week during a pregnancy, the user of the present invention peels back a tabbed rectangular area 106 corresponding to the associated week of the pregnancy. Reading each message through the term of the pregnancy informs the user as to the stages of fetal development.

Although the exemplary preferred embodiment described herein comprises 38 tabbed rectangular areas 106 labelled with associated week numbers 108 (namely "WEEK 3" through "WEEK 40"), any period of time may be used which relates to the length of the human fetal development process. One skilled in the art will recognize that daily or monthly events as well as events which relate to non-uniform periods of time could be associated with the tabbed rectangular areas 106.

One skilled in the art will further recognize that the present invention is distinguished from prior calendar designs in that it is not related to any specific day, month, or year. The calendar of the present invention is linked to the date of conception of the developing fetus and may be utilized regardless of the associated starting chronological date.

In addition, it will be readily recognized that tabbed rectangular areas 106 may be of any shape which permits a user to lift the pre-cut tab and fold it back over a hinged edge, or to remove the tabbed shape, to reveal an informative message printed underneath.

Figure 2:
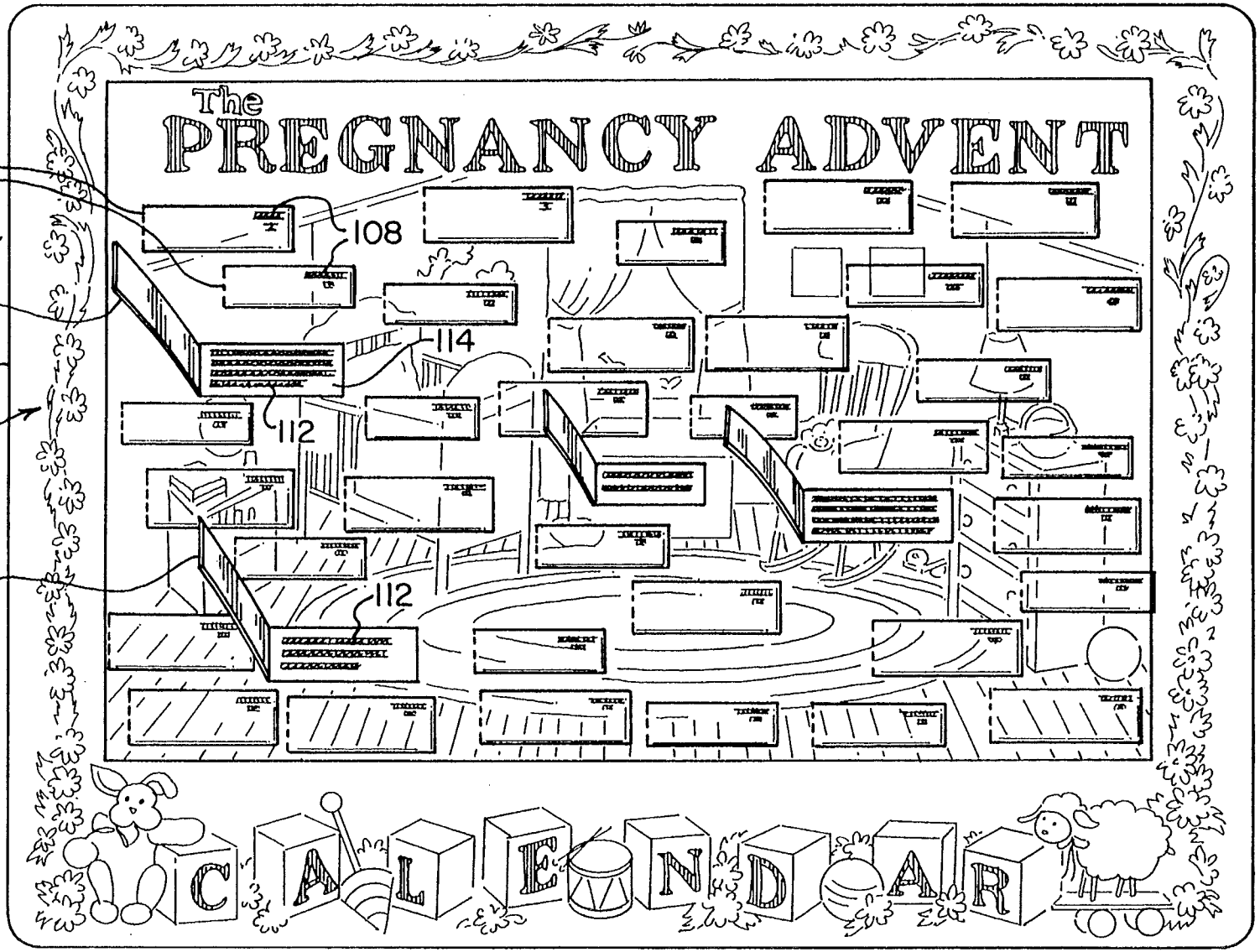
FIG. 2 shows the same calendar of FIG. 1 with the tabbed rectangular areas emphasized more than the graphical image.

FIG. 2 shows the same front view of calendar 100 of the present invention but with image 104 de-emphasized in order to emphasize tabbed rectangular areas 106 formed in upper paper layer 102. Particular exemplary tabbed rectangular areas 110 are shown in an opened position, folded back from upper paper layer 102 to reveal messages 112 printed on substrate paper layer 114. Messages 112, as shown in FIG. 2, are too small for legible detail and are therefor depicted only as horizontal lines representative of textual messages.

Figure 3:
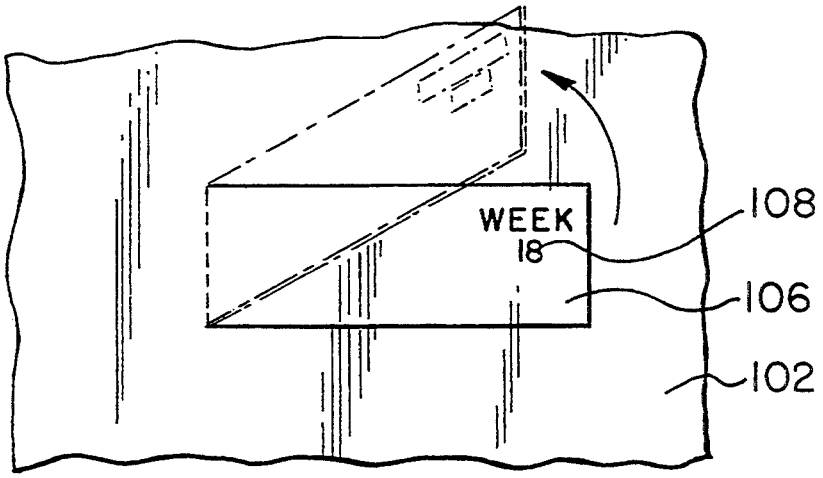
FIG. 3 shows one exemplary tabbed rectangular area on the upper paper layer of the calendar of FIG. 1 indicating the manner in which it may be pulled open.

FIG. 3 shows additional detail of an exemplary tabbed rectangular area 106 with a labelled week number 108 for "WEEK 18" of the gestation period. Tabbed rectangular area 106 is further depicted by dashed lines hinging at its left side partially folded back to an open position. One skilled in the art will recognize that tabbed rectangular area 106 may be formed in upper paper layer 102 such that it may be folded along any one of its four edges.

Figure 4:
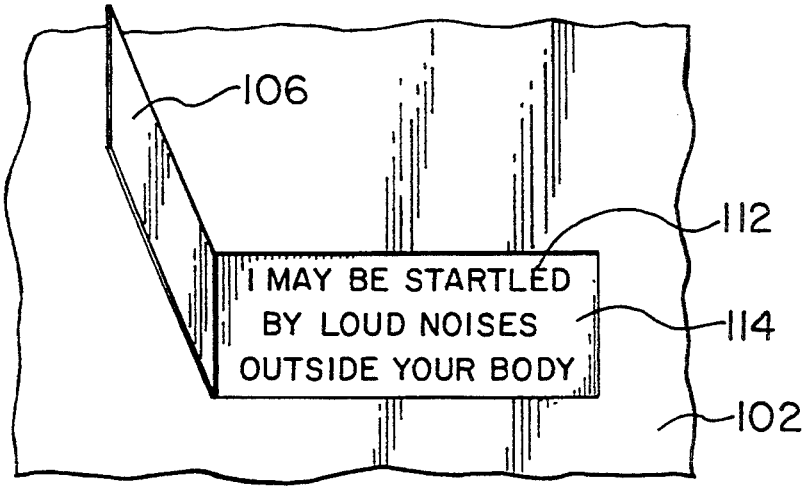
FIG. 4 shows the tabbed rectangular area of FIG. 3 opened to reveal the informative message printed below on the substrate paper layer.
Figure 5:
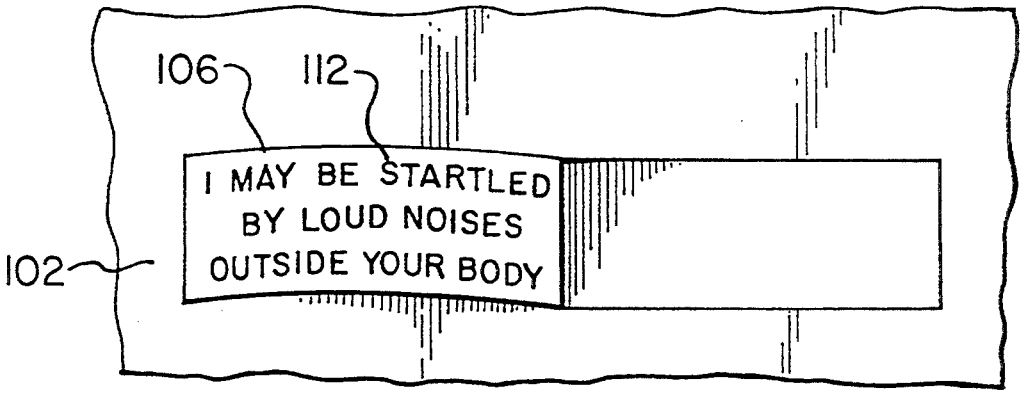
FIG. 5 shows the tabbed rectangular area of FIG. 3 opened to reveal the informative message printed on the back side of the opened tabbed rectangular area.

In FIG. 4, tabbed rectangular area 106 is shown hinged at its left side fully opened to reveal the message 112, "I MAY BE STARTLED BY LOUD NOISES OUTSIDE YOUR BODY", printed on substrate paper layer 114. This exemplary message corresponds to "WEEK 18" of the human gestation period. FIG. 5 depicts a alternative embodiment of the present invention in which message 112 is printed on the back side of tabbed rectangular area 106. As shown in FIG. 5, message 112 is read by a user when tabbed rectangular area 106 is folded back to its open position. In either case depicted in FIGS. 4 and 5, message 112 is revealed by folding back tabbed rectangular area 106 from upper paper layer 102.

As shown in FIGS. 1 and 2, the position of tabbed rectangular areas 106 within upper paper layer 102 is randomized to challenge the mother in finding the appropriate week. In addition, the sizes of the several tabbed rectangular areas 106 are varied, in part to disrupt any undesirable monotonous patterned appearance. The sizes of the tabbed rectangular areas 106 are also varied to accommodate the size of the textual message 112. Folding back a particular tabbed rectangular area 106 reveals a message 112 printed upon substrate paper layer 114. Message 112 is framed by, and viewed through, an opening in upper paper layer 102 created by the lifting of a corresponding tabbed rectangular area 106. The length of the several messages 112 varies and therefor so varies the required size of the opening in upper paper layer 102 through which the message is viewed and framed.

An exemplary set of messages for the human gestation period is as follows:

| WEEK NUMBER | MESSAGE |
|---|---|
| 3 | Conception has recently occurred! I am a cluster of rapidly multiplying cells traveling along the fallopian tube toward the womb. |
| 4 | I have arrived in the womb, and have "anchored" myself in the uterine lining. Many developments are underway! Among other things, the amniotic cavity is beginning to form. |
| 5 | I am about 1/10" long. My skeleton is forming, and my brain has 2 lobes. |
| 6 | I have a head and body; and buds that will later become my arms & legs begin to appear. |
| 7 | I am approximately ½" long. Impressions of what will become my fingers and toes appear. The right and left hemispheres of my brain are growing and my heart has 2 chambers. |
| 8 | All of my main internal organs are now present, and they continue to mature. My face looks more human-like. |
| 9 | My arms & legs are longer now; and my fingers & toes are better defined. Eyelids almost cover my eye, and I can move around. |
| 10 | I am about 1¾" long. My eyes are closed now and will remain so until the 27th week. My wrists & ankles are formed, and my fingers & toes are clearly recognizable. |
| 11 | My development as a baby boy or a baby girl will be complete in just 3 more weeks (although gender was determined at conception). My fingernails begin to appear. |
| 12 | I am approximately 2½" long. The centers of my bones are now hardening; and the pituitary gland in my brain begins to produce many hormones. |
| 13 | I am growing by "leaps and bounds", yet I still have lots of room to swoop and flutter about. My face is "prettier" now, that is more human-like! |
| 14 | I can kick, curl my fingers & toes, and make many facial expressions. My neck is growing, and I measure about 3¾" long. |
| 15 | Lanugo, which is fine hair, now covers my body; and the hair on my head & eyebrows is becoming coarser. I may even be sucking my thumb! |
| 16 | Sometime between now and the next few weeks you can feel me flitting about. It may feel like butterflies in your tummy, but it's really me! |
| 17 | I am starting to acquire a little fat, which is good for my producing and retaining heat. I am about 7¼" long and weigh about 4 oz. |
| 18 | I may be startled by loud noises outside your body. |
| 19 | I am about 9" long. The hair on my head is beginning to grow a bit longer. |
| 20 | I am quite active these days! Perhaps you can even see some of my movements. I weigh approximately 9 oz. |
| 21 | This week I am about 11" long, yet I still have plenty of room to move around. I also swallow some of the amniotic fluid. |
| 22 | I have probably established a fairly consistent pattern of sleeping and waking. My fingertips are covered by fingernails; and my eyelids and eyebrows are well defined. |
| 23 | I am getting "chubbier" all of the time! I |

-continued

| WEEK NUMBER | MESSAGE |
|---|---|
| | weigh almost one pound, and my face looks more like that of a newborn baby. |
| 24 | The space inside the womb is becoming increasingly snug for me. I am approximately 13" long. |
| 25 | I would tip the scales at about 1½ pounds this week. My bones are strengthening and getting harder. |
| 26 | My skin, which has been transparent and thin until this time, is now becoming opaque. A creamy substance called vernix coats my wrinkly body. |
| 27 | My eyelids open at about this time and I can look around! My size is about 2 pounds and 15". |
| 28 | The development of my brain is profound during this time. Also, the hair on my head is growing longer! |
| 29 | I am about 2½ pounds & 16½" long. My head is now basically proportionate to the rest of me. |
| 30 | By this week my weight has quintupled that of just 10 weeks ago! |
| 31 | I'm approximately 3½ pounds and 18" long. If you occasionally notice some rhythmic jerky movements, I just may be having an attack of the hiccups! |
| 32 | I am basically perfectly formed! However, I still need some more insulating fat, and some lung surfactant (so my lungs don't stick together when deflated). |
| 33 | By now I am most likely in the head down position. I measure roughly 4½ pounds, and 19½", and I may be gaining as much as 8 oz. per week! |
| 34 | My "quarters" are becoming more and more snug, as I don't have much room to move around anymore. My skin is becoming pinker! |
| 35 | I have plumped out considerably. I even can distinguish lightness and darkness! |
| 36 | I may be practicing my breathing by swallowing amniotic fluid, which can give me the hiccups! I measure approximately 6 pounds and 20". |
| 37 | At about this time I will probably become "engaged", meaning my head will be nestle and wedged into the pelvic cavity, in preparation of labor. |
| 38 | I weigh approximately 3 times as much as I did at 28 weeks. I may be gaining as much as one oz. per day! |
| 39 | I have hardly any room in which to move. I am about 7¼ pounds and 21". My lungs continue to mature as I will soon be breathing on my own! |
| 40 | I'M READY! |

As can be seen by one skilled in the art, the precise text of the messages may vary within the scope and spirit of the present invention. The above text messages are intended only as exemplary of messages used to inform or educate the user as to the human fetal development process. Alternatively, the printed information to be conveyed may relate to any time constrained development process. Child development, plant or animal development, and development of inanimate objects are exemplary of other applications of the present invention.

It will be recognized by one skilled in the art that any period of time may be chosen for the messages. As discussed above, the messages of the exemplary preferred embodiment are oriented toward weekly progress in the time interval comprising human fetal development. Alternatively, messages could be oriented toward daily or monthly progress as well as non-uniform periods of time.

It is to be understood that the claimed invention is not limited to the description of the preferred embodiment, but encompasses other modifications and alterations within the scope and spirit of the inventive concept.

I claim:

1. A calendar for informing a user regarding fetal development during a plurality of weeks of the human gestation period, said calendar comprising:

a first layer having a top surface;

a plurality of printed indicia on said top surface of said first layer, each of said printed indicia providing information regarding fetal development during a unique week of the human fetal development process;

a second layer having a top surface covering said top surface of said first layer, said second layer having an image disposed on said top surface of said second layer relating to a maternity motif;

a plurality of polygonal tabs formed in said second layer within said image, each of said plurality of polygonal tabs being moveable between an open position to reveal one of said plurality of printed indicia on said first layer and a closed position covering said one of said plurality of printed indicia on said first layer; and indicia means on each of said polygonal tabs for associating the polygonal tab with a unique week of the human gestation period and with the corresponding printed indicia on said first layer covered by the polygonal tab.

2. A calendar for informing a user regarding fetal development during weeks of the human gestation period, said calendar comprising:

a substrate material having a front side with an image relating to a maternity motif;

a plurality of polygonal tabs formed in said substrate material within said image, each one of said plurality of polygonal tabs having a nominally visible front side and a nominally concealed back side, each one of said plurality of polygonal tabs being moveable between an normally closed position concealing said back side and an open position revealing said back side;

a plurality of printed indicia each applied to the back side of an associated one of said plurality of polygonal tabs, each of said printed indicia providing information regarding a unique week of the human gestation period; and indicia means on the front side of each of said polygonal tabs for associating the polygonal tab with a unique week of the human gestation period and with the corresponding printed indicia on said back side of the polygonal tab.

3. A calendar for informing a user regarding fetal development during weeks of the human gestation period, said calendar comprising:

a substrate material having a front side with an image relating to a maternity motif;

a plurality of printed indicia associated with a back side of said substrate material, each of said plurality of printed indicia providing information regarding a unique week of the human gestation period;

a plurality of polygonal tabs formed in said substrate material with said image, each one of said plurality of polygonal tabs having a front side and being moveable between a normally closed position, concealing an associated one of said plurality of printed indicia, and an open position revealing an associated one of said plurality of printed indicia; and indicia means on the front side of each of said polygonal tabs for associating the polygonal tab with a unique week of the human gestation period and with the corresponding printed indicia normally concealed by the polygonal tab.

4. The calendar of claim 3 further comprising a second material layer having a top side affixed to said back side of said substrate material wherein said printed indicia are applied to said top side of said second material layer such that each one of said plurality of printed indicia is concealed by a corresponding one of said plurality of polygonal tabs and is revealed by moving the polygonal tab to its open position.

5. The calendar of claim 3 wherein said printed indicia are applied to a back side of each of said plurality of polygonal tabs wherein the printed indicia on the back side of the polygonal tab is concealed when the polygonal tab is in its closed position and wherein the printed indicia is revealed when the polygonal tab is in its open position.

* * * * *